US007513973B2

(12) United States Patent
Stoyanov et al.

(10) Patent No.: US 7,513,973 B2
(45) Date of Patent: Apr. 7, 2009

(54) BLEACHED POLYACRYLIC ACID CROSSLINKED CELLULOSIC FIBERS

(75) Inventors: Angel Stoyanov, Seattle, WA (US); R. Scott Stephens, Auburn, WA (US); Shahrokh A. Naieni, Seattle, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 34 days.

(21) Appl. No.: 10/815,143

(22) Filed: Mar. 31, 2004

(65) Prior Publication Data

US 2005/0217810 A1 Oct. 6, 2005

(51) Int. Cl.
*D21C 9/16* (2006.01)

(52) U.S. Cl. ..... 162/24; 162/78; 162/158; 8/107; 8/111

(58) Field of Classification Search ..... 162/9, 162/78, 162, 24, 158; 8/107, 111
See application file for complete search history.

(56) References Cited

U.S. PATENT DOCUMENTS

| | | | | |
|---|---|---|---|---|
| 4,822,453 | A * | 4/1989 | Dean et al. | 162/157.6 |
| 5,549,791 | A | 8/1996 | Herron et al. | |
| 5,562,740 | A | 10/1996 | Cook et al. | |
| 5,637,193 | A * | 6/1997 | Hassi et al. | 162/78 |
| 5,998,511 | A | 12/1999 | Westland et al. | |
| 6,211,296 | B1 * | 4/2001 | Frate et al. | 525/207 |
| 6,306,251 | B1 | 10/2001 | Jewell et al. | |
| 6,620,865 | B2 * | 9/2003 | Westland et al. | 524/13 |
| 2002/0157189 | A1 * | 10/2002 | Wang et al. | 8/111 |
| 2003/0208859 | A1 * | 11/2003 | Neogi et al. | 8/919 |

FOREIGN PATENT DOCUMENTS

| | | |
|---|---|---|
| DE | 1 001 889 | 1/1957 |
| EP | 0 429 112 A2 | 5/1991 |
| EP | 0 440 472 A1 | 8/1991 |
| WO | WO 95/25837 A1 | 9/1995 |

OTHER PUBLICATIONS

E.W. Haylock, J.P. "Paper, Its making, merchanting and usage" 3rd ed, The National Association of Paper Merchants, London, 1974, p. 46.*

Hawley's Condensed Chemical Dictionary, 14th ed, John Wiley & Sons, 2002 [Retrieved on Mar. 13, 2006]. Retrieved from <www.knovel.com/knovel2/Toc.jsp?BookID=704>.*

* cited by examiner

*Primary Examiner*—Eric Hug
*Assistant Examiner*—Dennis Cordray
(74) *Attorney, Agent, or Firm*—Christensen O'Connor Johnson Kindness

(57) ABSTRACT

Bleached polyacrylic acid crosslinked cellulosic fibers, methods for making the fibers, and products including the fibers. The bleached polyacrylic acid crosslinked cellulosic fibers are polyacrylic acid crosslinked cellulosic fibers that have been treated with one or more bleaching agents to provide crosslinked cellulosic fibers having improved whiteness.

7 Claims, No Drawings

BLEACHED POLYACRYLIC ACID CROSSLINKED CELLULOSIC FIBERS

FIELD OF THE INVENTION

The present invention relates to bleached polyacrylic acid crosslinked cellulosic fibers and methods for making and using bleached polyacrylic acid crosslinked cellulosic fibers.

BACKGROUND OF THE INVENTION

Cellulosic fibers are a basic component of absorbent products such as diapers. These fibers form a liquid absorbent structure, a key functioning element in the absorbent product. Cellulosic fluff pulp, a form of cellulosic fibers, is a preferred fiber for this application because a high void volume or high bulk, liquid absorbent fiber structure is formed. This structure, however, tends to collapse on wetting. The collapse or reduction in fiber structure bulk reduces the volume of liquid which can be retained in the wetted structure and inhibits the wicking of liquid into the unwetted portion of the cellulose fiber structure. Consequently, the potential capacity of the dry high bulk fiber structure is never realized and it is the fiber structure's wet bulk which determines the liquid holding capacity of the overall fiber structure.

Fiber structures formed from crosslinked cellulosic fibers generally have enhanced wet bulk compared to those formed from uncrosslinked fibers. The enhanced bulk is a consequence of the stiffness, twist, and curl imparted to the fiber as a result of crosslinking. Accordingly, crosslinked fibers are advantageously incorporated into absorbent products to enhance their wet bulk.

Polycarboxylic acids have been used to crosslink cellulosic fibers. See, for example, U.S. Pat. No. 5,137,537; U.S. Pat. No. 5,183,707; and U.S. Pat. No. 5,190,563. These references describe absorbent structures containing individualized cellulosic fibers crosslinked with a C2-C9 polycarboxylic acid. Absorbent structures made from these individualized, crosslinked fibers exhibit increased dry and wet resilience and have improved responsiveness to wetting relative to structures containing uncrosslinked fibers. Furthermore, a preferred polycarboxylic crosslinking agent, citric acid, is available in large quantities at relatively low prices making it commercially competitive with formaldehyde and formaldehyde addition products.

Despite the advantages that polycarboxylic acid crosslinking agents provide, cellulosic fibers crosslinked with low molecular weight polycarboxylic acids such as citric acid, tend to lose their crosslinks over time and revert to uncrosslinked fibers. For example, citric acid crosslinked fibers show a considerable loss of crosslinks on storage. Such a reversion of crosslinking generally defeats the purpose of fiber crosslinking, which is to increase the fiber's bulk and capacity. Thus, the useful shelf-life of fibers crosslinked with these polycarboxylic acids is relatively short and renders the fibers somewhat limited in their utility. Polymeric polycarboxylic acid crosslinked fibers, however, exhibit a density that remains substantially unchanged over the life-time of fibrous webs prepared from these fibers. See, for example, U.S. Pat. No. 6,620,865. This resistance to aging or reversion of density relates to the stable intrafiber crosslinks formed using polymeric polycarboxylic acid crosslinking agents. In contrast, cellulose fibers crosslinked with citric acid show a considerable increase in density, accompanied by a loss of bulk and absorbent capacity over time. Generally, the increase in density indicates a decrease in the level of crosslinking (i.e., reversion) in the fibers. In addition to density increase, the loss of crosslinking in the fibrous web results in a less bulky web and, consequently, diminished absorbent capacity and liquid acquisition capability.

Unfortunately, citric acid or polycarboxylic acid crosslinking agents can cause discoloration (i.e., yellowing) of the white cellulosic fibers at the elevated temperatures required to effect the crosslinking reaction.

Bleaching is a common method for increasing pulp brightness of pulp. Industry practice for improving appearance of fluff pulp is to bleach the pulp to ever-higher levels of brightness (the Technical Association of the Pulp & Paper Industry ("TAPPI") or the International Organization for Standardization ("ISO")). Traditional bleaching agents include elemental chlorine, chlorine dioxide, and hypochlorites. However, bleaching is expensive, environmentally harsh, and often a source of manufacturing bottleneck. Widespread consumer preference for a brighter, whiter pulp drives manufacturers to pursue ever more aggressive bleaching strategies. While highly bleached pulps are "whiter" than their less-bleached cousins, these pulps are still yellow-white in color. A yellow-white product is undesirable. Countless studies suggest that consumers clearly favor a blue-white over a yellow-white color. The former is perceived to be whiter, i.e., "fresh", "new" and "clean", while the latter is judged to be "old", "faded", and "dirty".

In addition to fiber discoloration, unpleasant odors can also be associated with the use of α-hydroxy carboxylic acids such as citric acid. Recently, it was found that the characteristic odor associated with citric acid crosslinked cellulosic fibers could be removed and the brightness improved by contacting the fibers with an alkaline solution (e.g., an aqueous solution of sodium hydroxide) and an oxidizing bleaching agent (e.g., hydrogen peroxide). See U.S. Pat. No. 5,562,740. In the method, the alkaline solution raises the finished fiber pH preferably to the 5.5-6.5 range from about 4.5. This, in combination with the oxidizing bleaching agent, eliminates the "smokey and burnt"odor characteristics of the citric acid crosslinked fibers. The oxidizing bleaching agent also helps to increase final product brightness.

Accordingly, there exists a need for crosslinked cellulosic fibers having advantageous bulk and improved brightness and whiteness. The present invention seeks to fulfill these needs and provides further related advantages.

SUMMARY OF THE INVENTION

In one aspect, the present invention provides bleached polyacrylic acid crosslinked cellulosic fibers. The bleached polyacrylic acid crosslinked cellulosic fibers of the invention are polyacrylic acid crosslinked cellulosic fibers that have been treated with one or more bleaching agents to provide crosslinked cellulosic fibers having high bulk and improved whiteness.

In another aspect of the invention, a method for making bleached polyacrylic acid crosslinked cellulosic fibers is provided. In the method, polyacrylic acid crosslinked cellulosic fibers are treated with one or more bleaching agents to provide crosslinked cellulosic fibers having improved whiteness. In one embodiment, the bleaching agent is hydrogen peroxide. In another embodiment, the bleaching agent is a combination of hydrogen peroxide and sodium hydroxide.

In other aspects, the invention provides absorbent products including wipes, towels, and tissues as well as infant diapers, adult incontinence products, and feminine hygiene products that include bleached polyacrylic acid crosslinked cellulosic fibers.

DETAILED DESCRIPTION OF THE PREFERRED EMBODIMENT

In one aspect, the present invention provides bleached polyacrylic acid crosslinked cellulosic fibers. The bleached polyacrylic acid crosslinked cellulosic fibers of the invention are polyacrylic acid crosslinked cellulosic fibers that have been treated with one or more bleaching agents to provide crosslinked cellulosic fibers having high bulk and improved whiteness, as measured by Whiteness Index described below. The bleached polyacrylic acid crosslinked fibers have increased whiteness (i.e., a greater Whiteness Index) compared to polyacrylic acid crosslinked fibers that have not been treated with a bleaching agent.

The bleached cellulosic fibers of the invention are made from polyacrylic acid crosslinked cellulosic fibers. These crosslinked cellulosic fibers are obtained by treating cellulosic fibers with an amount of a polyacrylic acid crosslinking agent to provide intrafiber crosslinked cellulosic fibers having increased bulk.

Polyacrylic acid crosslinked cellulosic fibers and methods for making polyacrylic acid crosslinked cellulosic fibers are described in U.S. Pat. Nos. 5,549,791, 5,998,511, and 6,306,251, each expressly incorporated herein by reference in its entirety.

Polyacrylic acid crosslinked cellulosic fibers can be prepared by applying polyacrylic acid to the cellulosic fibers in an amount sufficient to effect intrafiber crosslinking. The amount applied to the cellulosic fibers can be from about 1 to about 10 percent by weight based on the total weight of fibers. In one embodiment, crosslinking agent in an amount from about 4 to about 6 percent by weight based on the total weight of dry fibers.

Polyacrylic acid crosslinked cellulosic fibers can be prepared using a crosslinking catalyst. Suitable catalysts can include acidic salts, such as ammonium chloride, ammonium sulfate, aluminum chloride, magnesium chloride, magnesium nitrate, and alkali metal salts of phosphorous-containing acids. In one embodiment, the crosslinking catalyst is sodium hypophosphite. The amount of catalyst used can vary from about 0.1 to about 5 percent by weight based on the total weight of dry fibers.

Although available from other sources, cellulosic fibers useful for making the bleached polyacrylic acid crosslinked cellulosic fibers of the invention are derived primarily from wood pulp. Suitable wood pulp fibers for use with the invention can be obtained from well-known chemical processes such as the kraft and sulfite processes, with or without subsequent bleaching. The pulp fibers may also be processed by thermomechanical, chemithermomechanical methods, or combinations thereof. The preferred pulp fiber is produced by chemical methods. Ground wood fibers, recycled or secondary wood pulp fibers, and bleached and unbleached wood pulp fibers can be used. A preferred starting material is prepared from long-fiber coniferous wood species, such as southern pine, Douglas fir, spruce, and hemlock. Details of the production of wood pulp fibers are well-known to those skilled in the art. Suitable fibers are commercially available from a number of companies, including the Weyerhaeuser Company. For example, suitable cellulose fibers produced from southern pine that are usable in making the present invention are available from the Weyerhaeuser Company under the designations CF416, CF405, NF405, PL416, FR416, FR516, and NB416.

The wood pulp fibers useful in the present invention can also be pretreated prior to use with the present invention. This pretreatment may include physical treatment, such as subjecting the fibers to steam or chemical treatment. Although not to be construed as a limitation, examples of pretreating fibers include the application of fire retardants to the fibers, and surfactants or other liquids, such as solvents, which modify the surface chemistry of the fibers. Other pretreatments include incorporation of antimicrobials, pigments, and densification or softening agents. Fibers pretreated with other chemicals, such as thermoplastic and thermosetting resins also may be used. Combinations of pretreatments also may be employed.

Polyacrylic acid crosslinked cellulose fibers useful in making the present invention may be prepared by a system and apparatus as described in U.S. Pat. No. 5,447,977 to Young, Sr. et al., expressly incorporated herein by reference in its entirety. Briefly, the fibers are prepared by a system and apparatus that includes a conveying device for transporting a mat or web of cellulose fibers through a fiber treatment zone; an applicator for applying a treatment substance from a source to the fibers at the fiber treatment zone; a fiberizer for separating the individual cellulose fibers comprising the mat to form a fiber output comprised of substantially unbroken and essentially singulated cellulose fibers; a dryer coupled to the fiberizer for flash evaporating residual moisture; and a controlled temperature zone for additional heating of fibers and an oven for curing the crosslinking agent, to form dried and cured individualized crosslinked fibers.

As used herein, the term "mat" refers to any nonwoven sheet structure comprising cellulose fibers or other fibers that are not covalently bound together. The fibers include fibers obtained from wood pulp or other sources including cotton rag, hemp, grasses, cane, cornstalks, cornhusks, or other suitable sources of cellulose fibers that may be laid into a sheet. The mat of cellulose fibers is preferably in an extended sheet form, and may be one of a number of baled sheets of discrete size or may be a continuous roll.

Each mat of cellulose fibers is transported by a conveying device, for example, a conveyor belt or a series of driven rollers. The conveying device carries the mats through the fiber treatment zone.

At the fiber treatment zone, a crosslinking agent solution is applied to the mat of cellulose fibers. The crosslinking agent solution is preferably applied to one or both surfaces of the mat using any one of a variety of methods known in the art, including spraying, rolling, or dipping. Once the crosslinking agent solution has been applied to the mat, the solution may be uniformly distributed through the mat, for example, by passing the mat through a pair of rollers.

After the mat's fibers have been treated with the crosslinking agent, the impregnated mat is fiberized by feeding the mat through a hammermill. The hammermill serves to disintegrate the mat into its component individual cellulose fibers, which are then air conveyed through a drying unit to remove the residual moisture. In a preferred embodiment, the fibrous mat is wet fiberized.

The resulting treated pulp is then air conveyed through an additional heating zone (e.g., a dryer) to bring the temperature of the pulp to the cure temperature. In one embodiment, the dryer comprises a first drying zone for receiving the fibers and for removing residual moisture from the fibers via a flash-drying method, and a second heating zone for curing the crosslinking agent. Alternatively, in another embodiment, the treated fibers are blown through a flash-dryer to remove residual moisture, heated to a curing temperature, and then transferred to an oven where the treated fibers are subsequently cured. Overall, the treated fibers are dried and then cured for a sufficient time and at a sufficient temperature to effect crosslinking. Typically, the fibers are oven-dried and cured for about 1 to about 20 minutes at a temperature from about 120° C. to about 200° C.

In another aspect of the invention, a method for making bleached polyacrylic acid crosslinked cellulosic fibers is provided. In the method, polyacrylic acid crosslinked cellulosic fibers are treated with one or more bleaching agents to provide polyacrylic acid crosslinked cellulosic fibers having improved whiteness (i.e., increased Whiteness Index).

The bleaching agent is applied to the polyacrylic acid crosslinked cellulosic fibers. In one embodiment, the bleaching agent is hydrogen peroxide. In another embodiment, the bleaching agent is a combination of hydrogen peroxide and sodium hydroxide. Other suitable bleaching agents include peroxy acids (e.g. peracetic acid), sodium peroxide, chlorine dioxide, sodium chlorite, and sodium hypochlorite. Mixtures of bleaching agents may also be used.

The polyacrylic acid crosslinked cellulosic fibers can be advantageously treated with from about 0.1 to about 20 pounds hydrogen peroxide per ton fiber. In one embodiment, the fibers are treated with from about 0.1 to about 10 pounds hydrogen peroxide per ton fiber. In another embodiment, the fibers are treated with from about 0.1 to about 2 pounds hydrogen peroxide per ton fiber.

In one embodiment of the method, the bleaching agent is applied to polyacrylic acid crosslinked fibers by spraying hydrogen peroxide and sodium hydroxide into an air stream containing the polyacrylic acid crosslinked fibers. In this embodiment, up to about 5 pounds sodium hydroxide per ton fiber can be applied to the fibers. In one embodiment, the polyacrylic acid crosslinked fibers are dry. The resulting bleached polyacrylic acid crosslinked fibers are then conveyed to a baling device where the product fibers are baled for shipment.

The properties and characteristics of the bleached polyacrylic acid crosslinked fibers of the invention are described below.

The polyacrylic acid crosslinked cellulose fibers, subsequently remoisturized and bleached as described in Table 1 and characterized in Table 2, were prepared by treating southern pine kraft pulp fibers (CF416, Weyerhaeuser Co.) with polyacrylic acid (ACUMER 9932, Rohm & Haas) (4% by weight polyacrylic acid based on the total oven-dry weight of fibers) and sodium hypophosphite (0.7% by weight based on the total oven-dry weight of fibers). The treated fibers were then cured at 193° C. for 8 minutes. The fibers were remoisturized with water or water containing the bleaching agents (i.e., hydrogen peroxide ($H_2O_2$)/sodium hydroxide (NaOH)) described in Table 1.

Samples A-H are referenced in Tables 1 and 2. Sample A is a control: polyacrylic acid crosslinked fibers that had no treatment with hydrogen peroxide or sodium hydroxide. Samples B-D were prepared by subjecting polyacrylic acid crosslinked fibers to 0.65, 1.5, and 3.4 kilograms hydrogen peroxide per air-dried metric ton fiber, respectively, without sodium hydroxide. Sample E was prepared by subjecting the polyacrylic acid crosslinked fibers to 1.2 kilograms sodium hydroxide per air-dried metric ton fiber without hydrogen peroxide. Samples F-H were prepared by subjecting the polyacrylic acid crosslinked fibers to 0.45, 1.45, and 4.0 kilograms hydrogen peroxide and 0.90, 1.45, and 1.6 kilograms sodium hydroxide per air-dried metric ton fiber, respectively. Table 1 summarizes the bleaching treatment providing the fiber samples (Samples A-H). The application amount is the amount of chemical solids (in kilograms) applied to one air-dried metric ton (admt) of crosslinked fibers. The values in parentheses are in units of pounds per ton. The experimental minimum (expt minimum) is a calculated value based on the measured moisture content of the remoisturized product. This is the amount of chemical applied with the amount of water necessary to achieve the measured moisture content. Because water is lost through evaporative cooling of the hot fiber, the actual amount of chemical applied is likely greater than the calculated experimental minimum. The calculation assumes that an air-dry metric ton is at 10 percent by weight moisture content.

TABLE 1

Bleach treatment comparison.

| | expt minimum in kg/admt (lbs/ton) | |
|---|---|---|
| Sample | $H_2O_2$ | NaOH |
| A | 0.0 | 0.0 |
| B | 0.65 (1.25) | 0.0 |
| C | 1.5 (2.95) | 0.0 |
| D | 3.4 (6.7) | 0.0 |
| E | 0.0 | 1.2 (2.3) |
| F | 0.45 (0.9) | 0.9 (1.8) |
| G | 1.45 (2.9) | 1.45 (2.9) |
| H | 4.0 (8.0) | 1.6 (3.2) |

To illustrate the principles of the invention, a discussion of whiteness and brightness is useful. *Webster's Dictionary* defines white as "the object color of greatest lightness characteristically perceived to belong to objects that reflect diffusely nearly all incident energy throughout the visible spectrum". Used as a noun or adjective, white is defined as "free from color". Most natural and many man-made products are never "free from color". Whether the "white" product is fluff pulp, paper, textiles, plastics, or teeth, there is almost always an intrinsic color, other than white, associated with it. Consider two hypothetical objects. The first meets Webster's definition of white: one characterized by a flat spectrum of high reflectance and a second, which is the first with a small amount of blue colorant added (resulting in an unequal spectrum). Most people will judge the second to be whiter, even though its total reflectance is lower in certain spectral regions. The first will be judged as a "yellow-white" while the second a "blue-white". Further, with the subjectivity of human color vision certain associations are unconsciously made. Blue-white is associated with "clean and pure", while "yellow-white" denotes "dirty, old or impure". Consequently, the types and amounts of fillers and colorants, which hues are appropriate (e.g., red-blue, green-blue), and the optimal optical prescription to target have been the subject of considerable interest.

Whiteness attribute, not TAPPI brightness, better correlates with customer preference for product whiteness. When people are given a choice between two products having equal TAPPI brightness, usually the product exhibiting the higher whiteness attribute is preferred. The application of CIE Whiteness is but one measure of such a whiteness attribute. Similarly, a product having higher whiteness than the product to which it is being compared is preferred even when the former exhibits a lower brightness. TAPPI Brightness in North America and ISO Brightness throughout the rest of the world, are pulp and paper industry-specific standards used to loosely quantify the "whiteness" of a product. Regardless of which standard is applied, TAPPI or ISO, brightness is defined as the percent reflectance of product measured at an effective wavelength of 457 nm. In general, higher brightness is perceived by the industry to imply higher whiteness, but this is not always the case. Because brightness is a bandlimited measurement taken in the blue end of the visible spectrum, it essentially measures how blue a product is. If a brightness specification is relied on, it is possible to maximize TAPPI brightness, yet produce a product that appears blue, not white. Brightness provides little indication of how white a product is nor does it tell anything about its lightness, hue, or saturation. As a whiteness specification, it is insufficient. Such is the danger of pursuing brightness when whiteness is the principal objective.

L, a and b are used to designate measured values of three attributes of surface-color appearance as follows: L represents lightness, increasing from zero for black to 100 for perfect white; a represents redness when positive, greenness when negative, and zero for gray; and b represents yellowness when positive, blueness when negative, and zero for gray. The concept of opponent colors was proposed by Hering in 1878. Since the 1940s, a number of measurable L, a, b dimensions have been defined by equations relating them to the basic CIE XYZ tristimulus quantities defined in CIE Document No. 15. Measured values for a given color will depend on color space in which they are expressed [(TAPPI T 1213 sp-98 "Optical measurements terminology (related to appearance evaluation of paper")].

Basic color measurement is made using commercially available instruments (e.g., Technibrite MicroTB-1C, Technydine Corp.). The instrument scans through the brightness and color filters. Fifty readings are taken at each filter position and averaged. The measurements are reported as Brightness, R(X), R(Y), and R(Z). Brightness is ISO brightness (457 nm), R(X) is absolute red reflectance (595 nm), R(Y) is absolute green reflectance (557 nm), and R(Z) is absolute blue reflectance (455 nm). The CIE tristimulus functions X, Y, and Z are then computed in accordance with the following equations: X=0.782 R(X)+0.198 R(Z), Y=R(Y), and Z=1.181 R(Z). Next L, a and b values are computed using the established equations (Technibrite Micro TB-1C Instruction Manual TTM 575-08, Oct. 30, 1989). Whiteness Index, $WI_{(CDM-L)}$, was calculated according to the equation, $WI_{(CDM-L)}=L-3b$, according to TAPPI T 1216 sp-98 (TAPPI T 1216 sp-98 "Indices for whiteness, yellowness, brightness and luminous reflectance factor").

The Whiteness Index and Hunter color values for Samples A-H are presented in Table 2. Color (Hunter L, a, b) and Whiteness Index (WI) are provided as initial values, values after one day, and values after 14 days.

TABLE 2

Whiteness Index and Hunter Color Values.

| | Hunter L | | | Hunter a | | | Hunter b | | | Whiteness Index | | |
|---|---|---|---|---|---|---|---|---|---|---|---|---|
| Sample | 0 | 1 | 14 | 0 | 1 | 14 | 0 | 1 | 14 | 0 | 1 | 14 |
| A | 95.2 | 95.4 | 95.5 | −0.82 | −0.65 | −0.80 | 7.43 | 6.84 | 7.20 | 72.9 | 74.8 | 73.9 |
| B | 95.6 | 95.9 | 96.4 | −0.83 | −0.65 | −0.77 | 7.14 | 5.72 | 5.05 | 74.2 | 78.7 | 81.3 |
| C | 95.6 | 96.1 | 96.6 | −0.93 | −0.62 | −0.71 | 7.04 | 5.15 | 4.17 | 74.5 | 80.7 | 84.1 |
| D | 96.1 | 96.5 | 96.8 | −0.94 | −0.61 | −0.69 | 6.06 | 4.52 | 3.51 | 77.9 | 82.9 | 86.3 |
| E | 95.3 | 95.4 | 95.1 | −0.75 | −0.64 | −0.54 | 7.13 | 6.80 | 7.42 | 73.9 | 75.0 | 72.8 |
| F | 95.5 | 95.6 | 95.5 | −0.74 | −0.59 | −0.75 | 7.10 | 6.52 | 6.75 | 74.2 | 76.0 | 75.2 |
| G | 95.8 | 96.1 | 95.7 | −0.73 | −0.55 | −0.72 | 6.13 | 5.29 | 5.95 | 77.4 | 80.2 | 77.9 |
| H | 95.9 | 96.4 | 96.5 | −0.82 | −0.62 | −0.74 | 5.92 | 4.97 | 4.48 | 78.2 | 81.5 | 83.1 |

Referring to the whiteness and color values presented in Table 2, Hunter L increases with increasing amounts of hydrogen peroxide and Hunter b decreases with increasing hydrogen peroxide, thereby increasing Whiteness Index (WI). For example, using day 0 measurements for Samples A-D, increasing amounts of hydrogen peroxide increase Hunter L (95.2, 95.6, 95.6, 96.1) and decrease Hunter b (7.43, 7.14, 7.04, 6.06). The same trends are apparent with Samples E-H with sodium hydroxide present. Hunter L increases (95.3, 95.5, 95.8, 95.9) and Hunter b (7.13, 7.10, 6.13, 5.92) decreases. However, the change in Hunter b is affected by the addition of sodium hydroxide. For example, a comparison of Sample C (1.5 kg hydrogen peroxide) and Sample G (1.45 kg hydrogen peroxide) finds the Hunter b value of 7.04 (Sample C) without sodium hydroxide at day 0 and 6.13 (Sample G) with sodium hydroxide at day 0. The sodium hydroxide treated material has about a one point advantage. However, after 14 days storage in the dark the sample (G) treated with sodium hydroxide is essentially unchanged at 5.95 while the Hunter b of the sample (C) without sodium hydroxide has dropped to 3.51. The sodium hydroxide treated material is now disadvantaged by over two points compared to the sample with no sodium hydroxide application. Overall, the best results, as indicated by increase in the Whiteness Index, occur over time (e.g., 14 days) and are achieved by treatment with hydrogen peroxide alone (see Samples B-D).

The bleached polyacrylic acid crosslinked cellulosic fibers of the invention can be advantageously incorporated into a variety of products, including, for example, paper boards, tissues, towels, and wipes, and personal care absorbent products, such as infant diapers, incontinence products, and feminine care products. Thus, in another aspect, the invention provides absorbent products including wipes, towels, and tissues as well as infant diapers, adult incontinence products, and feminine hygiene products that include bleached polyacrylic acid crosslinked cellulosic fibers.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. Polyacrylic acid crosslinked cellulosic fibers subsequently treated with hydrogen peroxide alone, wherein the Whiteness Index of the polyacrylic acid crosslinked fibers treated with hydrogen peroxide increases from a first value determined at least one day after treatment of the polyacrylic acid crosslinked fibers with hydrogen peroxide to a second value determined up to 14 days after treatment with hydrogen peroxide.

2. The fibers of claim 1, having a Whiteness Index greater than about 75.0.

3. A method for making bleached polyacrylic acid crosslinked fibers, comprising spraying hydrogen peroxide alone into an air stream containing polyacrylic acid crosslinked fibers, wherein the Whiteness Index of the polyacrylic acid crosslinked fibers treated with hydrogen peroxide increases from a first value determined at least one day after treatment of the polyacrylic acid crosslinked fibers with hydrogen peroxide to a second value determined up to 14 days after treatment with hydrogen peroxide.

4. The method of claim 3, wherein hydrogen peroxide is applied to the fibers in an amount from about 0.1 to about 20 pounds per ton fiber.

5. An absorbent product, comprising bleached polyacrylic acid crosslinked cellulosic fibers, wherein the bleached polyacrylic acid crosslinked cellulosic fibers comprise polyacrylic acid crosslinked cellulosic fibers subsequently treated with hydrogen peroxide alone, wherein the Whiteness Index of the polyacrylic acid crosslinked fibers treated with hydrogen peroxide increases from a first value determined at least one day after treatment of the polyacrylic acid crosslinked fibers with hydrogen peroxide to a second value determined up to 14 days after treatment with hydrogen peroxide.

6. The product of claim 5, wherein the product is a wipe, tissue, or towel.

7. The product of claim 5, wherein the product is an infant diaper, adult incontinence product, or feminine hygiene product.

* * * * *